United States Patent [19]

Bresson et al.

[11] 4,416,770

[45] Nov. 22, 1983

[54] SELECTIVE MINERAL RECOVERY

[75] Inventors: Clarence R. Bresson; Robert M. Parlman, both of Bartlesville, Okla.

[73] Assignee: Phillips Petroleum Company, Bartlesville, Okla.

[21] Appl. No.: 383,370

[22] Filed: May 28, 1982

[51] Int. Cl.[3] ..... B03D 1/14

[52] U.S. Cl. ..... 209/167; 209/166; 252/61

[58] Field of Search ..... 568/62; 252/61; 209/166, 167

[56] References Cited

U.S. PATENT DOCUMENTS 3,785,488 1/1974 Werneke .

4,295,962 10/1981 Parlman ..... 209/167

FOREIGN PATENT DOCUMENTS 1071336 2/1980 Canada .

*Primary Examiner*—Bernard Nozick

[57] ABSTRACT

Recovery of copper and iron from ores is enhanced by adding beta-mercaptoethanol as a depressant to a froth flotation process. Flotation of sulfides of zinc and lead is reduced.

8 Claims, No Drawings

SELECTIVE MINERAL RECOVERY

This invention relates to the selective recovery of a mineral.

In one aspect, this invention relates to a novel depressant utilized in froth flotation processes wherein sulfides of lead and zinc are selectively depressed and the flotation thereof is reduced.

In still another aspect, this invention relates to the use of beta-mercaptoethanol in the recovery of iron or copper from ores by selectively suppressing flotation of a sulfide of lead or zinc.

BACKGROUND OF THE INVENTION

Deposits of ores generally contain more than one valuable mineral. To be sold as separate products, the valuable minerals must be separated from each other. Also, valuable minerals must be separated from less valuable minerals and host rock. Such less valuable minerals and host rock are frequently referred to as gangue. For example, copper sulfide and iron sulfide ores are often present together with sulfides of other metals such as zinc and lead, and these minerals are generally found in their natural state associated with gangue materials.

Froth flotation processes are one means used to concentrate and recover desired valuable minerals. Such processes can be used to separate one valuable mineral from another and to separate valuable minerals from gangue. Froth flotation processes are based upon the affinity of particles of a given mineral for bubbles under certain conditions. The bubbles attract and float one or more minerals while other minerals or gangue material sink.

In conventional froth flotation, the ore is ground into fine particles. The fine particles are admixed with a flotation fluid such as water, brine, etc., to form a pulp. A froth is formed by agitating the pulp while passing a gaseous stream such as air through the pulp.

Various reagents can be added to the pulp to aid in forming the froth, floating certain minerals, preventing the flotation of certain minerals, etc. These reagents are often broadly referred to as flotation process aids or flotation agents. These reagents include frothers, collectors, activators, pH regulators, flocculents, dispersants, and depressants.

Frothers are reagents which can be used in ore flotation to aid in forming bubbles and a stable froth in which the minerals to be recovered are collected. Typical frothers are pine oil, methyl isobutyl carbinol and poly(propylene glycol)methylethers.

Collectors can be added to a flotation process to assist in the concentration of a mineral in the froth. Generally, collectors create an affinity between a bubble and a particular mineral particle. The bubble then can buoy the mineral particle to the surface of the flotation fluid. Different collectors are preferably used for different minerals, for example, sulfides of lead, zinc, copper and nickel can be collected and floated by short-chain hydrocarbons ($C_2$–$C_5$) of the sulfhydryl type. Oxide minerals, on the other hand, are typically collected and floated by long-chain ($C_{12}$–$C_{18}$) fatty acids, sulfonates, and amines.

Activators can be added to flotation processes to obtain improve collector attachment to the mineral to be floated. The activators generally interact with or are attached to the mineral to be floated. The activator also can interact with or attach to the collector and thus serve as an intermediate for flotation. For instance, copper sulfate is known to activate zinc and thus aid in the flotation of zinc in some circumstances.

A pH regulator can be added to a pulp to control the ionization of a collector from its molecular to its ionic species. This can affect the forces of attraction or repulsion between a collector and a mineral, absorption of the collector to the mineral, and/or flotation. Various pH regulators such as acidic or basic compounds are known in the art.

A dispersant can be added to a flotation system to ensure that co-flocculation of a desired mineral and gangue does not occur. Lignin sulfonates, sodium silicate, tannin, and others are typical dispersants.

A flocculent can be added to a flotation step to cause agglomeration of only desired particles. The floccules can then be removed by froth flotation. Known flocculents include starches and gums.

A depressant can be added to a flotation system to prevent or reduce the flotation of a certain mineral. Depressants are frequently referred to as suppressants. A specific depressant can selectively prevent or reduce assimilation in the froth of a certain mineral or group of minerals or gangue materials.

For example, in the recovery of copper sulfide, lime can be added as a depressant. Lime can depress pyrite which is frequently present in significant quantities in copper sulfide ores.

Also, certain depressants are known to selectively depress copper sulfide in the recovery of other minerals under certain flotation conditions. Sodium thiophosphate, U.S. Pat. No. 2,811,255; thioglycolic acid, U.S. Pat. No. 2,449,984; and thioglycerol, U.S. Pat. No. 3,785,488 are known copper sulfide depressants.

Also it is known in the art, for example, to use sodium cyanide to selectively depress sulfides of copper and iron while allowing lead sulfide to float.

Thus, although many disclosures and much improvement has been made in the field of depressants utilized in recovery of minerals, there is considerable room for further improvement. For instance, there is a need for depressants which will selectively depress sulfides of lead and zinc while permitting minerals containing copper or iron to float.

THE INVENTION

It is an object of this invention to provide an improved froth flotation process for recovery of iron and copper from iron- and copper-containing ores.

It is another object of this invention to provide a depressant which will selectively depress or reduce the flotation of a sulfide of lead or zinc.

Still another object of this invention is to provide a froth flotation process for the recovery of sulfides of copper and iron which minimizes or limits contamination of such with sulfidized minerals of lead or zinc.

It has been discovered that beta-mercaptoethanol (2-mercapto-1-hydroxyethane), hereinafter referred to as BME, is effective as a depressant in froth flotation processes. It has been found that BME can selectively prevent or reduce the flotation of a sulfide of lead and/or zinc while allowing other minerals such as a sulfide of copper and/or iron to float.

BME, $HOCH_2CH_2SH$, is a water-soluble liquid with a pour point below −50° F. BME does not have the acute toxicity of other depressants such as sodium cyanide.

BME is preferred as a selective depressant for sulfides of lead or zinc which may be collected by or activated by reagents used in froth flotation seeking to recover copper or iron. By proper use of BME, froths having a substantially reduced concentration of a sulfide selected from the group consisting of sulfides of lead and zinc can be obtained. A lower concentration of undesired sulfides of lead or zinc advantageously yields cleaner froth flotation concentrates of a desired mineral such as a sulfide selected from the group consisting of sulfides of iron or copper.

BME has been found to be a very selective depressant. BME preferentially suppresses certain metals in the presence of others. For example, BME can be added to a molybdenum recovery flotation process in an amount conducive to the suppression of copper, iron, and lead. This invention relates to the recovery of a sulfide of copper or iron by the selective use of BME to suppress a sulfide of zinc or lead. Ores comprising sulfides of copper, iron, lead and zinc can thus be upgraded by using BME to suppress sulfides of lead and zinc. The term "upgraded" as used herein refers to increasing the concentration of a desired metal such as copper or iron in a froth by, in part, depressing or reducing the concentration in the froth of an undesired metal such as lead or zinc.

In accordance with one embodiment of this invention, BME is used as a depressant to provide an improved froth flotation process. An ore containing lead or zinc sulfides along with other minerals such as copper or iron can be ground to a suitable size for flotation. Preferably, the ore is ground to a particle size in the range of about 25 to about 500 microns. The ore can be dry ground, tht is, the ore can be ground in the absence of a flotation or grinding fluid such as water or brine. A flotation fluid such as water then can be added to the dry ground ore to form a pulp. Preferably, the ore is wet ground with a suitable amount of flotation fluid and a residual amount of flotation fluid added or removed to achieve a desired pulp concentration.

The pulp so formed can be fed to a conventional froth flotation cell or a series of such cells. Flotation reagents can be added to the pulp to achieve flotation of desired minerals. One or more flotation reagents selected from the group consisting of a collector, a frother, an activator, a dispersant, a floculent, a pH regulator, and a depressant can be added to the froth flotation process. For example, collectors such as xanthates, dithiocarbonates, dithiophosphates, or salts or other derivatives thereof and the like can be added to the pulp.

A gaseous stream such as air can be added to the pulp in the flotation cell to form bubbles and a resulting froth. The pulp and gaseous stream can be mixed or combined by agitation, mixing, etc. The froth so obtained should comprise a concentrate of the mineral or minerals to be recovered. A series of flotation cells can be used to obtain a higher concentration of a desired mineral in the final froth. The desired mineral can be recovered from the froth by conventional techniques such as filtration, leaching, drying, etc.

BME as a depressant is preferably added to the froth flotation process to selectively depress zinc and/or lead sulfide ores. BME can be added to or combined with the ore prior to or during a grinding step to obtain a significant suppression of zinc or lead. BME can be added during a wet grinding step, typically called regrind, wherein the ground ore, flotation fluid, and depressant are mixed during grinding.

BME as a depressant is preferably added to the flotation device or cell wherein the depressant is mixed with the pulp, and/or other reagents in the cell during the flotation process. Preferably where the flotation process comprises more than one float such as a first float and at least one float in addition to the first float, BME is preferably added to the flotation cell after the first float to maximize lead and zinc suppression. BME is most preferably added before a second float for additional zinc suppression and higher iron or copper recoveries. BME can be added in the same process step in which a collector, activator, etc., is added, or BME can be added in a different process step.

Most preferably, a first float and at least one float in addition to the first float are used and a first portion of BME is added to a grinding step prior to the first float to preferentially suppress zinc and a second or subsequent float to preferentially suppress lead. The first portion and second portion in each can be employed in the range of about 0.01 to about 2.0 pounds BME per ton of mineral ore, and in preferred ranges as described below.

Depending on the assay of the ore from which copper and/or iron are to be recovered, BME can be added to only one cell in a series of cells or can be added to more than one cell in a series to obtain an optimum depression of lead or zinc sulfide ores when such are not desired in a given froth. The concentrate from the first or rougher stages in the series of cells can be retreated in additional flotation cells. This retreatment or cleaning can increase the final content of the desired copper or iron minerals in the final froth. The cleaner concentrates can yield higher grades of separate mineral products.

It has been found that the amount of BME used in a flotation process can affect its effectiveness as a selective depressant. BME can be added to an ore flotation process in an amount conducive to the suppression of a sulfide selected from the group consisting of sulfides of lead and zinc, and conducive to allowing a sulfide selected from the group consisting of sulfides of iron and copper to float.

BME can be employed as a depressant in a quantity of about 0.01 to about 2.0 pounds of BME per ton of mineral ore. Preferably, BME is employed in a quantity in the range of about 0.05 to about 1.0 pounds of depressant per ton of mineral ores. Most preferably, BME is employed in the range of about 0.05 to about 0.25 pounds of BME per ton of ore, which amount is most conducive to suppression of a lead or zinc sulfide and which amount can permit an iron or copper sulfide to float.

BME can be used alone or in conjunction with other depressants such as lime, sodium cyanide, hydrophilic polyamines, hydrophilic polycarboxylic acids, sodium thiophosphate, sodium silicate, starch, guar gum, glue, proteins, tannins, and other known depressants. A combination of BME and other depressants can be used to depress sulfides of lead and/or zinc and other undesired minerals in a given flotation cell or process.

BME can be used as a depressant in froth flotation in conjunction with one or more flotation reagents. BME can be used with collectors, activators, flocculents, dispersants, pH regulators, other depressants and the like.

BME can be used as a depressant in froth flotation without a collector, etc., whenever the mineral to be recovered is substantially self-floating or naturally floatable. For instance, minerals such as molybdenite, graphite, talc, boric acid, and certain unoxidized sulfide minerals are substantially naturally floatable. BME can be used in such instance to suppress the flotation of sulfides of leads or zinc while allowing a mineral which is naturally floatable such as molybdenite to float.

While it is not considered to limit the invention herein disclosed and claimed, it is believed that the suppressant mechanism of BME is to absorb on the crystalline latice of the sulfides. It is also believed that the hydroxyethyl mercaptide ion, $HO\text{-}CH_2\text{-}CH_2\text{-}S^-$ behaves similarly to the sulfahydrate ion-SH in its ability to absorb on and impart a hydrophilic character to certain metal surfaces under specific flotation conditions. Various parameters affect the effectiveness of BME as a depressant for sulfides of lead and/or zinc. For example, the presence of other minerals, a concentration level of BME present in the flotation process, the assay content of the raw ore, collector or other flotation reagent selected, and other flotation process parameters can affect the effectiveness of BME as a suppressant.

The following examples are intended to further illustrate the invention without undue limitation of its scope.

EXAMPLE I

This example is a first control flotation test. No BME was used in this example. This example shows the significant amounts of lead and of zinc which are floated in the presence of copper and iron and in the absence of BME as a depressant.

In this example (and all following examples) a two-float test was used. That is, specific reagents were added during grinding or just prior to a first float, and other specific reagents were added prior to a second float.

1250 milliliters of water were added to 2500 grams of an ore containing 3.18 wt. % lead, 0.39 wt. % zinc, 0.24 wt. % copper, and 1.58 wt. % iron. The ore was ground in the presence of the water for 9.2 minutes to form a slurry. The ground ore in the slurry was characterized as a 23%+100 Tyler mesh size grind.

The slurry so formed was added to a 10 liter Denver flotation cell. Also, various reagents were added to the flotation cell. The term "lbs./ton" as used herein refers to the amount of reagent added expressed in equivalent pounds of reagent per ton of raw ore. The following were added to the flotation cell, containing water and ore, to form a flotation mixture:

(1) 6.4 milliliters (about 0.064 lbs./ton) of 1.25 wt.% aqueous sodium isopropyl xanthate (Z-11), as a lead-zinc collector, (2) 6.25 milliters (0.5 lbs/ton) of 10% aqueous zinc sulfate, as a zinc depressant, (3) 2.5 drops (0.018 lbs/ton) of isopropyl ethylthionocarbamate (Z-200), and (4) 10.5 drops (0.1 lbs/ton) of n-hexanol, as a frother.

The flotation mixture was stirred at 1200 rpm for a few minutes. Air was then passed through the stirred flotation mixture and lead was floated. The froth was collected for analyses.

The flotation process was stopped to prepare for the second float. Then, 6.6 milliliters (0.066 lbs./ton) of 1.25 wt. % of aqueous copper sulfate was added to the cell. Copper sulfate was added to activate and float zinc. Also, added to the cell were 21 additional drops (0.2 lbs./ton) of n-hexanol frother. After conditioning for five minutes by stirring, the second float was continued by adding air to the cell for 5 minutes to float and collect zinc. The combined floats were then analyzed for individual metals or the corresponding sulfides. Table I below summarizes the results obtained.

TABLE I

Flotation of Pb, Zn, Cu, Fe Minerals (2-Floats)

Added before First Float: 1250 ml Water; 2500 grams ore; 0.064 lbs/ton Sodium Isopropyl Xanthate; 0.5 lbs/ton Zinc Sulfate; 0.018 lbs/ton Isopropyl Ethylthionocarbamate; 0.1 lbs/ton n-Hexanol Added before Second Float: 0.066 lbs/ton Copper Sulfate; 0.2 lbs./ton n-Hexanol

| Run | Rougher Concentrate, Grams | | | | | Rougher Tails, Grams | | | | | % Recovery | | | |
|---|---|---|---|---|---|---|---|---|---|---|---|---|---|---|
| No. | Total Wt. | Pb | Zn | Cu | Fe | Total Wt. | Pb | Zn | Cu | Fe | Pb | Zn | Cu | Fe |
| 1 | 142 | 90.2 | 8.32 | 3.14 | 4.15 | 2302 | 20.4 | .57 | 2.12 | 25.3 | 81.2 | 93.5 | 59.7 | 16.3 |
| 2 | 103.8 | 62.5 | 6.75 | 2.66 | 3.22 | 2330 | 28.0 | 1.51 | 2.56 | 22.4 | 69.1 | 81.7 | 50.4 | 12.2 |
| 3 | 112.3 | 66.0 | 7.30 | 2.76 | 3.37 | 2333 | 30.3 | 1.12 | 2.57 | 23.3 | 68.5 | 86.7 | 49.3 | 11.4 |
| | | | | | | | | | | Average = | 72.9 | 87.3 | 53.1 | 13.3 |

EXAMPLE II

This example is a second control flotation test. No BME was used in this example. In this example, various mercaptans were tested to determine if they could effectively depress or float lead or zinc in the presence of other minerals such as iron or copper. The test procedure of Example I was repeated except various reagent substitutions were made.

In the first test, the n-hexanol frother used in the second float was replaced with 9 drops (0.086 lbs/ton) of a mixture containing 80 wt. % tert-dodecyl mercaptan and 20 wt.% polypropylene glycol as a frother. The results of this first test are shown as Runs A.1.,A.2., and A.3. in Table II below.

In the second test, all reagents used in Example I were used again and, in addition, 9 drops (0.086 lbs./ton) of a mixture containing 80 wt.% n-dodecyl mercaptan and 20 wt.% polypropylene glycol. This second test is shown in Table II below as Runs B.4., B.5., and B.6.

The results are summarized in Table II. The results indicate that mercaptans are not useful under these flotation conditions as depressants for lead and zinc. The percent recovery of lead and zinc was increased rather than decreased when a mercaptan was used.

TABLE II

Effect of Mercaptan as a Reagent of Pb and Zn in Ore Flotation (2-Floats)

Added Before First Float: 1250 ml water; 2500 grams ore (same ore as Example I); 0.064 lbs/ton Isopropyl Xanthate; 0.5 lbs/ton Zinc Sulfate; 0.018 lbs/ton Isopropyl Ethylthionocarbamate; 0.1 lbs/ton n-Hexanol

| Run | Rougher Concentrate, Grams | | | | | Rougher Tails | | | | | % Recovery | | | |
|---|---|---|---|---|---|---|---|---|---|---|---|---|---|---|
| No. | Total | Pb | Zn | Cu | Fe | Total | Pb | Zn | Cu | Fe | Pb | Zn | Cu | Fe |
| A. Added Before Second Float: 0.086 lbs/ton of 80% tert-Dodecyl Mercaptan plus 20% Polypropylene Glycol and 0.066 lbs/ton Copper Sulfate | | | | | | | | | | | | | | |
| 1 | 151.8 | 102.8 | 7.89 | 3.04 | 3.95 | 2289 | 15.6 | .73 | 1.83 | 22.4 | 86.8 | 91.5 | 62.4 | 15.0 |
| 2 | 123.1 | 74.6 | 7.51 | 3.32 | 4.43 | 2314 | 25.4 | .80 | 1.78 | 21.8 | 74.6 | 90.4 | 65.1 | 16.9 |
| 3 | 133.1 | 80.1 | 8.12 | 2.86 | 3.59 | 2313 | 19.7 | .58 | 2.01 | 22.0 | 80.3 | 93.4 | 58.2 | 14.0 |
| | | | | | | | | | | Average = | 80.6 | 91.8 | 61.9 | 15.3 |
| B. Added Before Second Float: 0.086 lbs/ton 80% n-Dodecyl Mercaptan plus 20% Polypropylene Glycol, 0.066 lbs/ton Copper Sulfate, and 0.2 lbs./ton n-Hexanol. | | | | | | | | | | | | | | |
| 4 | 149.3 | 94.7 | 7.91 | 3.43 | 4.78 | 2291 | 17.4 | .69 | 1.63 | 22.9 | 84.5 | 92.0 | 67.8 | 17.3 |
| 5 | 140.5 | 87.8 | 7.87 | 3.23 | 4.00 | 2305 | 20.5 | .58 | 1.71 | 22.1 | 81.1 | 93.2 | 65.4 | 16.9 |
| 6 | 172.1 | 107.1 | 8.26 | 3.61 | 5.34 | 2267 | 14.5 | .43 | 1.61 | 22.2 | 88.1 | 95.0 | 69.2 | 19.4 |
| | | | | | | | | | | Average = | 84.6 | 93.4 | 67.5 | 17.9 |

EXAMPLE III

In this example, BME was used as depressant for lead and zinc. The test procedure of Example I was repeated in two separate tests using BME.

In the first test using BME, 19 drops (0.15 lbs./ton) of 98 wt. % pure BME was added during grinding of the ore with water and before the first float in place of zinc sulfate suppressant. No zinc sulfate was used in the first float. The first test runs are shown as Runs A.1., A.2., and A.3 of Table III below.

In the second test using BME, zinc sulfate solution was used in the first float. 19 drops (0.15 lbs./ton) of 98 wt. % pure BME was added to the flotation mixture after the first float prior to the second float. The second test runs are shown below in Table III as Runs B.4., B.5., and B.6.

TABLE III

Effect of Beta-Mercaptoethanol (BME) as a Depressant of Pb and Zn in Ore Flotation (2-Floats)

Flotation Mixture of Example I used, except as noted.

| Run | Rougher Concentrate, Grams | | | | | Rougher Tails | | | | | % Recovery | | | |
|---|---|---|---|---|---|---|---|---|---|---|---|---|---|---|
| No. | Total | Pb | Zn | Cu | Fe | Total | Pb | Zn | Cu | Fe | Pb | Zn | Cu | Fe |
| A. 0.15 lbs/ton BME Added to Grind. No Zinc Sulfate Used in First Float. | | | | | | | | | | | | | | |
| 1 | 78.4 | 42.6 | 4.70 | 2.67 | 3.37 | 2368 | 30.8 | 2.60 | 2.32 | 23.2 | 58.0 | 64.3 | 53.5 | 12.7 |
| 2 | 75.3 | 38.2 | 3.92 | 3.09 | 3.77 | 2363 | 35.4 | 3.54 | 2.36 | 22.7 | 51.9 | 52.5 | 56.7 | 14.2 |
| 3 | 86.8 | 54.7 | 3.04 | 1.74 | 2.52 | 2348 | 30.5 | 3.99 | 3.29 | 23.2 | 64.2 | 43.2 | 34.6 | 9.80 |
| | | | | | | | | | | Average = | 58.0 | 53.3 | 48.3 | 12.2 |
| B. 0.15 lbs/ton BME Added Before Second Float. | | | | | | | | | | | | | | |
| 4 | 133.8 | 91.9 | 2.81 | 2.94 | 3.88 | 2300 | 20.7 | 4.37 | 2.21 | 23.0 | 81.6 | 39.1 | 57.1 | 14.4 |
| 5 | 113.0 | 75.0 | 2.37 | 2.83 | 3.50 | 2221 | 26.7 | 4.66 | 2.44 | 22.2 | 73.7 | 33.7 | 53.7 | 13.6 |
| 6 | 100.0 | 67.1 | 1.71 | 2.42 | 2.99 | 2337 | 28.0 | 4.67 | 2.80 | 22.9 | 76.6 | 26.8 | 46.4 | 11.5 |
| | | | | | | | | | | Average = | 77.3 | 33.2 | 52.4 | 13.2 |

SUMMARY-TABLE IV

The data herein disclosed are summarized in Table IV. The data show that BME suppresses the flotation of lead and zinc while allowing copper and iron to float.

The data also show that is advantageous and preferable to add BME remotely prior to flotation to obtain significant lead suppression. For instance, BME addition to the grind stage can significantly reduce the flotation of lead. It is preferable, however, to add BME after grinding to maximize lead and zinc suppression. It is most preferable to add BME before the second float for additional zinc suppression and to obtain higher copper and iron recoveries and lower lead and zinc recoveries.

TABLE IV

Summary of Data

| Example: | Control I | Control IIA | Control IIB | Invention IIIA | Invention IIIB |
|---|---|---|---|---|---|
| A. Additives, lbs/ton Ore | | | | | |
| 1. Grind | | | | | |
| a. Beta-Mercaptoethanol | — | — | — | 0.15 | — |
| 2. First Float | | | | | |
| a. Z-11, Na Isopropyl Xanthate | 0.064 | 0.064 | 0.064 | 0.064 | 0.064 |
| b. Z-200, Isopropyl Ethylthionocarbamate | 0.018 | 0.018 | 0.018 | 0.018 | 0.018 |
| c. $ZnSO_4$ | 0.5 | 0.5 | 0.5 | — | 0.5 |
| d. n-Hexanol | 0.1 | 0.1 | 0.1 | 0.1 | 0.1 |
| 3. Second Float | | | | | |
| a. $CuSO_4$ | 0.066 | 0.066 | 0.066 | 0.066 | 0.066 |
| b. n-Hexanol | 0.2 | 0.2 | 0.2 | 0.2 | 0.2 |
| c. tert-$C_{12}$SH/Frother | — | 0.086 | — | — | — |
| d. n-$C_{12}$SH/Frother | — | — | 0.086 | — | — |
| e. Beta-Mercaptoethanol | — | — | — | — | 0.15 |
| B. % Recovery | | | | | |
| Pb | 72.9 | 80.6 | 84.6 | 58.0 | 77.3 |
| Zn | 87.3 | 91.8 | 93.4 | 53.3 | 33.2 |
| Cu | 53.1 | 61.9 | 67.5 | 48.3 | 52.4 |
| Fe | 13.3 | 15.3 | 17.9 | 12.2 | 13.2 |

Reasonable variations and modifications which will become apparent to those skilled in the art can be made in this invention without departing from the spirit and scope thereof. For example, BME can serve to depress undesirable sulfides of lead and/or zinc during nonmetallic mineral flotation such as the recovery of fluorspar, barite, silica, feldspar, etc., from their ores.

What is claimed is:

1. A froth flotation process comprising
(a) grinding ore comprising a sulfide selected from the group consisting of sulfides of iron and copper and comprising a sulfide selected from the group consisting of sulfides of lead and zinc to form a ground ore,
(b) admixing said ground ore with a flotation fluid to form a pulp,
(c) adding a flotation reagent to said pulp,
(d) adding beta-mercaptoethanol to said pulp in an amount conducive to the suppression of said sulfide selected from the group consisting of sulfides of lead and zinc,
(e) feeding a gaseous stream into said pulp to form a froth,
(f) removing said froth from said pulp, and
(g) recovering said sulfide selected from the group consisting of sulfides of copper and iron from said froth.

2. A froth flotation process comprising:
(a) grinding ore comprising a sulfide selected from the group consisting of sulfides of iron and copper and comprising a sulfide selected from the group consisting of sulfides of lead and zinc, in the presence of beta-mercaptoethanol in an amount conducive to the suppression of said sulfide selected from the group consisting of sulfides of lead and zinc, to form a ground ore
(b) admixing said ground ore with a flotation fluid to form a pulp,
(c) adding a flotation reagent to said pulp,
(d) feeding a gaseous stream into said pulp to form a froth,
(e) removing said froth from said pulp, and
(f) recovering said sulfide selected from the group consisting of sulfides of copper and iron from said froth.

3. A process in accordance with claim 2 wherein a first float and at least one float in addition to said first float are used and additional beta-mercaptoethanol is added after said first float.

4. A process in accordance with claim 1 wherein one or more flotation reagents selected from the group consisting of a frother, collector, activator, dispersant, flocculent, pH regulator, and depressant are added to the froth flotation process.

5. A froth flotation process wherein a pulp of flotation fluid and an ore comprising a sulfide selected from the group consisting of sulfides of iron and copper and comprising a sulfide selected from the group consisting of sulfides of lead and zinc is admixed with a gaseous stream to generate a mineral containing froth and wherein said sulfide selected from the group consisting of sulfides of copper and iron is recovered from said froth, the improvement comprising:

incorporating into said pulp a depressant comprising beta-mercaptoethanol in an amount conducive to the suppression of said sulfide selected from the group consisting of sulfides of lead and zinc.

6. A process in accordance with claim 5 wherein a first float and at least one float in addition to said first float are used and said beta-mercapoethanol is added after said first float.

7. A froth flotation process wherein an ore comprising a sulfide selected from the group consisting of sulfides of iron and copper and comprising a sulfide selected from the group consisting of sulfides of lead and zinc is ground to form a ground ore and said ground ore is admixed with a flotation fluid to form a pulp, wherein said pulp is admixed with a gaseous stream to generate a mineral containing froth and wherein said sulfide selected from the group consisting of sulfides of copper and iron is recovered from said froth, the improvement comprising:

adding beta-mercaptoethanol in an amount conducive to the suppression of said sulfide selected from the group consisting of sulfides of lead and zinc to said ore prior to or during grinding of said ore.

8. A process in accordance with any of claims 1–7 wherein beta-mercaptoethanol is employed in a quantity of about 0.01 to about 2.0 pounds of beta-mercaptoethanol per ton of mineral ore present in said pulp.

* * * * *